US009660406B2

(12) United States Patent
King, Jr. et al.

(10) Patent No.: US 9,660,406 B2
(45) Date of Patent: May 23, 2017

(54) PUSH-IN WIRE CONNECTOR WITH COLLAR

(71) Applicants: L. Herbert King, Jr., Jupiter, FL (US); James C Keeven, O'Fallon, MO (US); William Hiner, O'Fallon, MO (US); Frank Vlasaty, St. Louis, MO (US)

(72) Inventors: L. Herbert King, Jr., Jupiter, FL (US); James C Keeven, O'Fallon, MO (US); William Hiner, O'Fallon, MO (US); Frank Vlasaty, St. Louis, MO (US)

(73) Assignee: THE PATENT STORE LLC, O'Fallon, MO (US)

( * ) Notice: Subject to any disclaimer, the term of this patent is extended or adjusted under 35 U.S.C. 154(b) by 92 days.

(21) Appl. No.: 14/121,095

(22) Filed: Jul. 30, 2014

(65) Prior Publication Data

US 2015/0064985 A1 Mar. 5, 2015

Related U.S. Application Data

(60) Provisional application No. 61/959,712, filed on Aug. 30, 2013.

(51) Int. Cl.

| | |
|---|---|
| ***H01R 43/20*** | (2006.01) |
| ***H01R 11/09*** | (2006.01) |
| ***H01R 11/22*** | (2006.01) |
| ***H01R 43/00*** | (2006.01) |
| ***H01R 13/52*** | (2006.01) |

(52) U.S. Cl.

CPC ..... *H01R 43/005* (2013.01); *H01R 13/5213* (2013.01); *Y10T 29/49181* (2015.01)

(58) Field of Classification Search

CPC ..... H01R 11/22; H01R 11/09; H01R 43/05

See application file for complete search history.

(56) References Cited

U.S. PATENT DOCUMENTS

| | | | | | |
|---|---|---|---|---|---|
| 4,397,514 | A * | 8/1983 | Durand | H01R 4/4818 | 439/436 |
| 4,585,902 | A * | 4/1986 | Munroe | H01R 4/4818 | 174/84 S |
| 5,161,996 | A * | 11/1992 | Locati | H01R 12/7011 | 439/374 |
| 5,580,266 | A | 12/1996 | Shelly | | |
| 5,775,932 | A * | 7/1998 | Saito | H01R 13/629 | 439/358 |
| 6,183,287 | B1 * | 2/2001 | Po | H01R 13/629 | 439/358 |
| 6,860,756 | B2 | 3/2005 | Chen | | |
| 6,981,890 | B2 * | 1/2006 | Cutler | H01R 4/4827 | 439/441 |
| 7,229,313 | B1 * | 6/2007 | Keckler | H01R 4/4818 | 439/272 |
| 7,255,592 | B1 * | 8/2007 | Tseng | H01R 4/22 | 439/439 |
| 7,431,603 | B1 * | 10/2008 | Szmidt | H01R 4/4836 | 439/289 |
| 7,833,038 | B1 * | 11/2010 | King, Jr. | H01R 4/4818 | 439/276 |

(Continued)

*Primary Examiner* — Briggitte R Hammond

(74) *Attorney, Agent, or Firm* — Jacobson & Johnson LLC

(57) ABSTRACT

A wire connector having a collar surrounding a set of wire ports in a wire connector with the collar providing a collective shield between an environment external to the collar the collar but not between the set of wires within the collar.

13 Claims, 3 Drawing Sheets

(56) References Cited

U.S. PATENT DOCUMENTS

| | | | | |
|---|---|---|---|---|
| 7,972,166 | B2 | 7/2011 | Hiner et al. | |
| 8,033,859 | B2 * | 10/2011 | Giefers | H01R 4/489 439/441 |
| 8,052,462 | B2 | 11/2011 | King, Jr. et al. | |
| 2002/0052141 | A1 * | 5/2002 | Hattori | H01R 13/5205 439/587 |
| 2009/0017660 | A1 | 1/2009 | Braganza et al. | |

* cited by examiner

PUSH-IN WIRE CONNECTOR WITH COLLAR

CROSS REFERENCE TO RELATED APPLICATIONS

This application claims priority from provisional application 61/959,712 filed Aug. 30, 2013.

FIELD OF THE INVENTION

This invention relates generally to push-in wire connectors and, more specifically, to a universal push-in wire connector having a collar for collectively shielding different sizes or types of wires.

STATEMENT REGARDING FEDERALLY SPONSORED RESEARCH OR DEVELOPMENT

None

REFERENCE TO A MICROFICHE APPENDIX

None

BACKGROUND OF THE INVENTION

Twist on wire connectors having a single port for twistingly engaging two or more wires are known in the art. In one type of twist on wire connector a skirt is placed around the open coil end of the twist on wire connector. The skirt extends outward from the sides of the coil end in the twist on wire connector. In the event the bare ends of the wires, which are twistingly joined in a bundle in the wire connector, are axially uneven or if the twisting of wires causes the bare ends of the bundled wires to be axially displaced with respect to one another, the skirt, which extends outward from the coil provides isolation protection to ensure that any exposed portion of the bundled electrical wires is isolated from objects external to the wire connector. This type of wire connector with a single wire port and bundled wires relies on a frusto conical or cylindrical skirt located around the open end of the wire port of the individual twist-on wire connectors and requires each of the electrical wires to be simultaneously formed into electrical engagement with each other. An example of such a skirt is shown in U.S. Pat. No. 6,478,606.

SUMMARY OF THE INVENTION

A push-in wire connector having a plurality of wire ports with the plurality of wire ports surrounded by a single collar that isolates all the electrical wires from the environment external to the wire connector but not from each other with each of the wire ports, which are spaced from one another containing at least one resilient conductor wherein the spring force of the resilient conductor is sufficient to electrically engage a wire that is axially inserted into a port in the push-in connector. The multiport push-in wire connector allows one to sequentially insert individual wires into the push-in wire connector to sequentially form electrical connections between each of the wires while at the same time the collar collectively provides on-the-go isolation of each of the wires from the environment external to the wire connector.

DESCRIPTION OF THE PREFERRED EMBODIMENT

Figure 1:
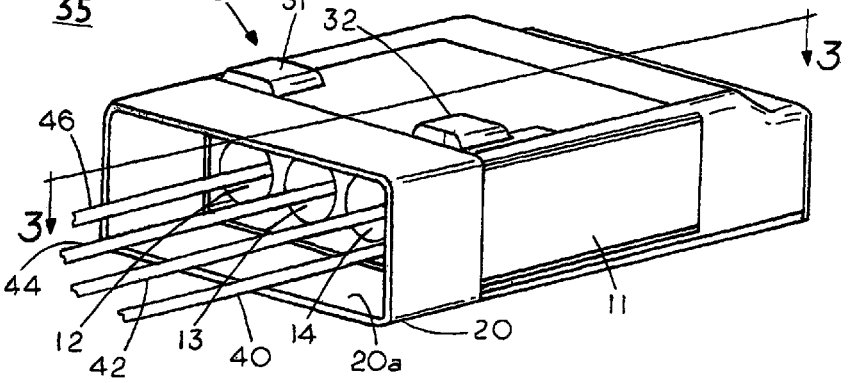
FIG. 1 shows a perspective view of a push-in wire connector with a multiport collar.
Figure 2:
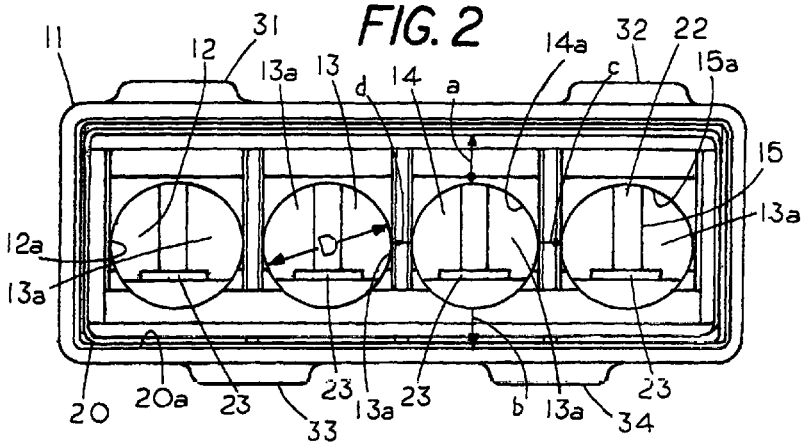
FIG. 2 shows a front view of a push-in wire connector of FIG. 1.

FIG. 1 shows a perspective view of a push-in wire connector 10 with a set of wires, 40, 42, 44 and 46 therein and for purposes of clarity FIG. 2 shows a front view of push-in wire connector 10 without the wires. Wire connector 10 includes a housing 11 having a first cylindrical wire socket or wire port 12, a second cylindrical wire socket or wire port 13, a third cylindrical wire socket or wire port 14 and a fourth cylindrical wire socket or wire port 15 each having an axial cylindrical wire inlet passage for axial insertion of a wire therein. As shown in FIG. 1 push-in wire connector 10 contains a first wire 46 in wire port 12, a second wire 44 in wire port 13, a third wire 42 in port 14 and a fourth wire 40 in wire port 15 (see FIG. 2) with each of the wires extending through an electrically insulating collar 20.

In joining ends of wires into an electrical connection in the waterproof push-in wire connector 10 a first end of a wire 46, which has been stripped of the electrical insulation cover, is axially inserted into first socket 12 and a further wire end 44, which has also been stripped of the electrical insulation cover is axially inserted into second socket 13 with each of the bare wire ends entering into engagement with a common bus strip 23, which is visible in ports 12, 13, 14, and 15 (FIG. 2) to form an electrical connection between the ends of the wires. In the example shown in FIG. 3 wire 42, which has a stripped end 41 has been axially inserted into port 15 for forming electrical contact with the common bus strip 23. The common bus strip 23 allows each of the individual wires 40, 42, 44 and 46 to be electrically joined within the push-in wire connector 10 through axial insertion of the wires into the respective ports of the push-in wire connector.

The push-in wire connector 10 allows one to quickly form an electrical connection of a number of wires of different size to each other through use of multiple ports and a common bus strip 23 since the resilient members in each port of the push-in wire connector flexes to adapt to the size of the electrical wire. That is, by axially inserting a wire into electrical contact the at least one resilient member 21 or 22 in the push-in wire connector in port 15 one forms electrical contact between the electrical wire and the bus strip.

Figure 3:
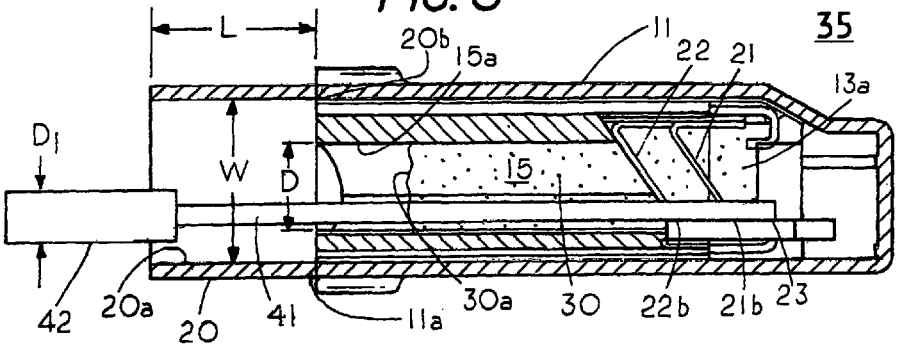
FIG. 3 shows a cross sectional view of the push-in wire connector of FIG. 1 taken along lines 3-3.

FIG. 3 shows resilient strips 21 and 22 that frictionally engaging a wire end 41 with the edges 22*b* and 21*b* of the resilient strips biting into the wire 41 to both form an electrical contact and hold the wire 41 within the wire port so that the wire cannot be accidentally pulled out of the connector. Similarly, identical resilient strips within the other ports engage a wire end therein with the edges of the resilient strips biting into the wire to both form an electrical contact and hold the wire within the wire port so that the wires cannot be accidentally pulled out of the connector.

A feature of the push-in wire connectors with a collar is that a protected electrical connection between two or more wires can be obtained without requiring additional steps such as rotating a bundle of wires, squeezing the bundle of wires or forcing jaws or clamps around the bundle of electrical wires. In addition, in order to avoid accidentally electrical contact between the wires in the axial passages and the environment outside the wire connector the invention described herein utilizes a single electrically insulating collar to surround all of the wires but not an individual wire. This feature allows one to easily insert a single wire or at a later time insert additional wires in the push-in wire connector. That is, on-the-go one can insert single wires into the connector. For example, one wire at a time since there is no individual collar around the wire port to hinder the sequential insertion of wires into electrical engagement in the push-in wire connector.

To illustrate the formation of the electrical connection with a collar 20 reference can be made to FIG. 3 which shows a cross sectional view of push-in wire connector 10 taken along plane 3-3 of FIG. 1. Push-in wire connector 10 comprises a one-piece housing 11, which for example may be made from an electrical insulating material such as a polymer plastic and may include two or more wire passages therein which in the embodiment shown are identical to each other although the size and shape of the wire passages may be of different size or shape without departing from the spirit and scope of the invention. FIG. 3 shows a chamber 13*a* therein on one end of housing 11 and a cylindrical wire passage 15 formed by a cylindrical wall 15*a* extending into housing 11. Located in the chamber 13*a* and held in position by housing 11 is an electrical conductor comprising an elongated bus strip 23. Positioned proximate to the bus strip 23 is a first V shaped resilient member comprising a resilient electrical conductor 21 having a wire contact region comprising an edge 21*b* for scrapingly engaging an outer surface of an electrical wire and a second V shaped resilient member comprising a resilient electrical conductor 22 having a wire contact region comprising an edge 22*b* member into for scrapingly engaging an outer surface of an electrical wire to bring the resilient members into an electrical connection. In the example shown each of resilient conductors 21 and 22 are formed at an acute angle Θ so that the wire engaging edge 21*b* and wire engaging edge 22*b* of each of the resilient conductors exerts a downward pressure on a wire located on the bus strip 23 with sufficient force so as to maintain an electrical connection between a wire therein and the resilient conductor in the presence of the sealant. While resilient springs are shown other wire securement means may be incorporated into the push-in wire connectors.

FIG. 3 shows that the electrically insulating collar 20, which is secured to port end of push-in wire connector 10 has an interior surface 20*a* with the collar having a length L and a width W with the width W greater than the diameter D of the wire passage 13. In some cases collar 20 may be made from a rigid electrically insulating material and in other cases collar 20 may be made from a flexible electrically insulating material. In this example the multiport collar 20 is setback in all-lateral directions from the wire ports in the push-in wire connector.

A feature of the invention is that the universal push-in wire connector 10 can form an electrical connection with a protective collar for a plurality of electrical wires that are not bundled together. FIG. 3 shows that housing 11 contains a chamber 13*a* with a bus strip 23 located therein. Housing 11 includes a first axial wire passage 12 in communication with the chamber 13*a*, a second axial wire passage 13 in communication with the chamber 13*a*, a third axial wire passage 14 in communication with chamber 13*a* and a fourth axial wire passage 15 with each of the axial wire passages having a port for insertion of an electrical wire therein. In this example, as shown in FIG. 2, each of the axial wire passage are located in a side by side condition in housing. As each of the wire engaging portions within the connector are the same only axial passage 13 is described herein, however, it is within the scope of the invention to have different wire engaging members in the axial passages.

FIG. 3 shows a first resilient conductor 22 having a wire engaging edge 22*b* for electrically engaging of a wire end 41, which has been axially inserted into the first wire port 13*a*. Connector 10 includes a second resilient conductor 21 having a wire engaging edge 21*b* for electrically engaging of the wire axially inserted into wire port 13*a* with the first resilient conductor and the second resilient conductor located in the chamber 13*a* in the housing 11. In this example a bus strip 23 electrically connects the first resilient conductor 22 to the second resilient conductor 23 so that a wire 41 engages the first resilient conductor 22 and a second electrical wire connector 21, which brings the first electrical wire 40, the second electrical wire 42, the third electrical wire 44 and the fourth electrical wire 46 into electrical communication with each other through the common bus strip 23 and the resilient members located therein.

Located external to the housing 11 is the electrically insulated collar 20 having a first end 20*b* secured to end 11*a* of housing 11 with electrically insulated collar 20 radially or laterally spaced from a sidewall 12*a* wire port 12, a sidewall 13*a* wire port 13, a sidewall 14*a* wire port 14 and a sidewall 15*a* wire port 15, as well as laterally spaced from the wires 40, 42, 44, and 46. In the example shown the collar 20 simultaneously encompasses the first wire port 12, the second wire port 13, the third wire port 14 and the fourth wire port 14 with the collar 20 cantilevered outward from an end 11*a* of the housing. In this example the collar provides unfettered access to each of the wire ports 12, 13, 14 and 15 while inhibiting electrical contact between a wire in either of the wire ports and an object external to electrical insulated collar.

As shown in FIG. 3 the electrical wire 41 is located within the collar 20 to protect the electrical wire from the environment 35 external to the wire connector, however, the collar 20 is not needed to protect the wires 40, 42, 44 and 46 from electrical contact with each other within the collar 20 since wires 40, 42, 44 and 46 are connected to the same bus strip 23.

As can be seen in FIG. 1 the collar 20 does not hinder formation of an electrical connection within housing 11 since there is sufficient space to axially insert the wire end yet at the same time the collar protects each of the electrical wires therein from contact with an object in the environment 35 external to the wire connector 10.

In the example shown the first resilient conductor 22 may exert a larger downward force than the second resilient conductor 21 through the use of resilient conductors of the same material but of different thickness. Consequently, in some cases the rigidity of the wires may be the such that only one of the resilient conductors is in engagement with the wire. If the ends of the wires have been stripped to the same length a portion of the stripped end of the wire may extend outside the port of the push-in wire connector. In other cases the stripping of the wire ends may not be equal which may cause a portion of the stripped end of the wire to extend outside the wire port of the push-in wire connector.

FIG. 2 shows and end view of the push-in connector with each of the wire ports 12, 13, 14 and 15 spaced from each other. For example port 22 is spaced from port 15 and port 13. Port 22 is also spaced from the bottom of the housing by a distance "b" and the top of the housing by a distance "a". FIG. 2 show the collar 20 is setback from the wire ports to provide an enlarged wire entry. That is, the single collar 20 extends around the end of housing 11 and encompasses all four wire ports 12, 13, 14, and 15 with the collar laterally setback from the wire ports to provide access to the ports in the push-in wire connector. While the push-in wire connector is shown with insulating and waterproofing material 30 in the connector 10 the collar of the present invention may be used with a push-in wire connector without an insulating and waterproofing material therein.

Figure 4:
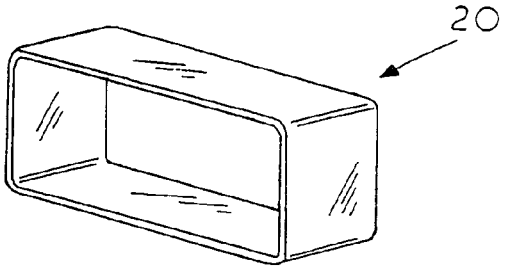
FIG. 4 shows a perspective view of a collar for a push-in wire connector.
Figure 5:
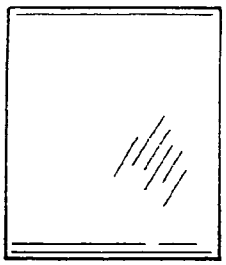
FIG. 5 shows a left side view of the collar of FIG. 4.
Figure 6:
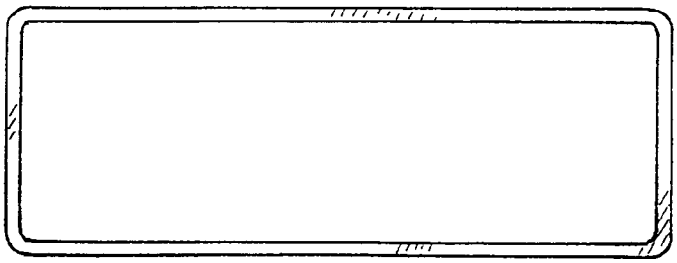
FIG. 6 shows front view of the push-in wire connector of FIG. 4.
Figure 7:
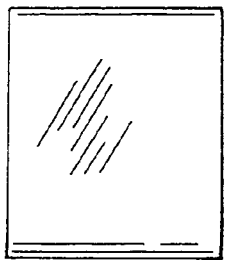
FIG. 7 shows a right side view of the collar of FIG. 4.
Figure 8:
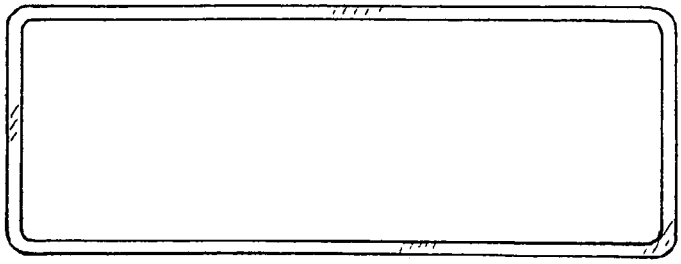
FIG. 8 shows a back view of the push-in wire connector of FIG. 4.
Figure 9:
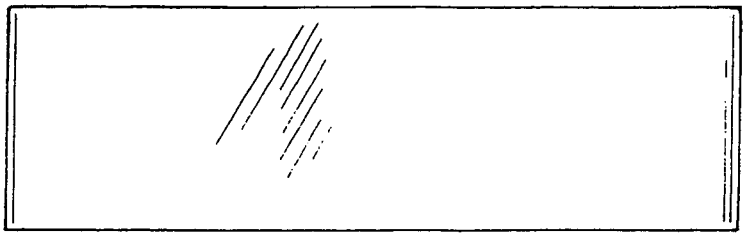
FIG. 9 shows a top view of the push-in wire connector of FIG. 4.
Figure 10:
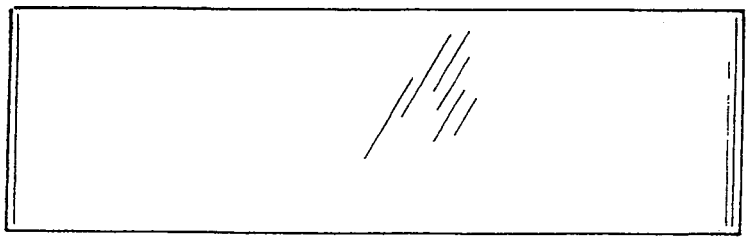
FIG. 10 shows a bottom view of the push-in wire connector of FIG. 4.

To illustrate the ornamental design of the push-in collar 20 references should be made to FIG. 4 to FIG. 11 where:

FIG. 4 shows a perspective view of a push-in collar 20 for securing to an end face of a push-in wire connector;

FIG. 5 shows a left side view of the push-in collar 20 of FIG. 4;

FIG. 6 shows front view of the push-in collar 20 of FIG. 4;

FIG. 7 shows a right side view of the push-in collar 20 of FIG. 4;

FIG. 8 shows a back view of the push-in collar 20 of FIG. 4;

FIG. 9 shows a top view of the push-in collar 20 of FIG. 4;

FIG. 10 shows a bottom view of the push-in collar 20 of FIG. 1; and

Figure 11:
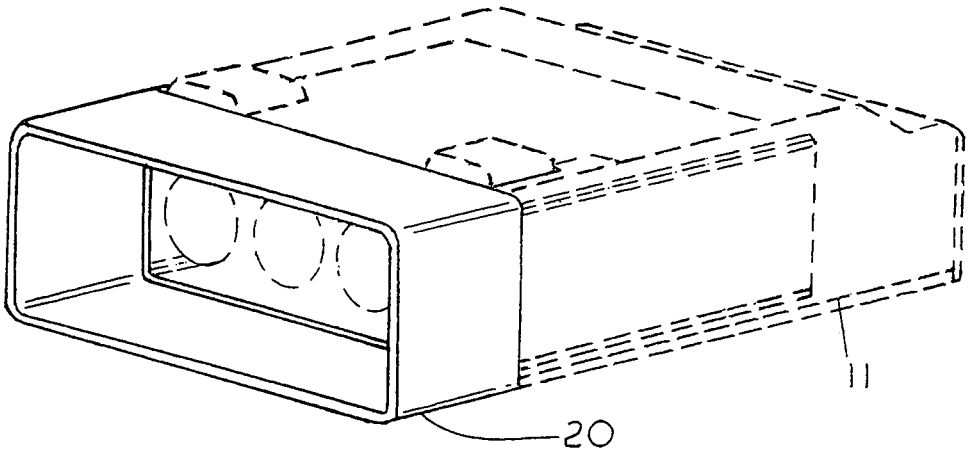
FIG. 11 is a perspective view of a push-in wire connector 11 in dashed lines with a collar 20 mounted proximate the end of the push-in wire connector.

FIG. 11 shows a perspective of a push-in wire connector 11 in dashed lines with a push-in collar 20 of FIG. 4 mounted proximate the end of the push-in wire connector.

We claim:

1. A universal push-in wire connector for forming an electrical connection with a plurality of electrical wires comprising:

a housing having an open front end and a closed back end with a chamber therebetween;

a first axial wire passage in the open front end of said housing in communication with the chamber and a second axial wire passage in the open front end of said housing in communication with the chamber, said first axial wire passage having a first wire port for axial insertion of an electrical wire therein and said second axial wire passage having a second wire port for axial insertion of a further electrical wire therein with said first axial wire passage and said second axial wire passage located in a side by side condition in said housing;

a first resilient conductor having a wire engaging edge for electrically engaging of a wire axially inserted into the first wire port and a second resilient conductor having a wire engaging edge for electrically engaging of a wire axially inserted into the second wire port with the first resilient conductor and the second resilient conductor located in the chamber in the housing;

a bus strip located in said chamber, said bus strip electrically connecting said first resilient conductor to the second resilient conductor so that a wire engagement of the first resilient conductor and a further wire engagement with the second electrical wire connector bring the first electrical wire and the second electrical wire into electrical communication with each other; and an electrically insulated collar having a first end secured to said housing with said electrically insulated collar spaced from and simultaneously encompassing both the first wire port and the second wire port, said collar cantilevered outward from an end of the housing containing the first wire port and the second wire port to enable on-the-go wire access to said first wire port and said second wire port while inhibiting electrical contact between a wire in either said first wire port or said second wire port and an environment external to said electrical insulated collar.

2. The universal push-in wire connector of claim 1 wherein the electrically insulated collar surrounds the first axial passage and the second axial passage to separate a portion of an electrical wire in each of the axial passages from an environment external to the housing while not separating a portion of each of the electrical wires in the axial passages from each other.

3. The universal push-in wire connector of claim 1 including four axial passages with an electrical wire in each of the passages where the collar encompasses a portion of each electrical wire proximate an entrance to each of the axial passages to isolate the portion of each electrical wire proximate the entrance from an external environment but not from each other.

4. The universal push-in wire connector of claim 1 wherein each of the electrical wires have an electrical insulation covering that extends into the collar but not into an axial passage.

5. The universal push-in wire connector of claim 1 wherein a width of the collar is larger than a diameter of a wire in an axial port to allow the wire to flex within the collar.

6. The universal push-in wire connector of claim 1 wherein the collar is rigid.

7. The universal push-in wire connector of claim 1 wherein a length of the collar is greater than a diameter of either a first axial passage or a second axial passage.

8. The universal push-in wire connector of claim 1 wherein the collar is laterally offset from each of an axial passages to facilitate axial entry into each of the axial passages.

9. The universal push-in wire connector of claim 1 wherein each side of the wire passage is off act from an internal face of the collar.

10. A method of connecting at least two wires into an electrical connection while isolating the wires from an environment external to a push-in wire connector comprising:

placing a collar around a plurality of wire ports on the push-in wire connector and securing the collar to the push-in wire connector;

stripping a first wire end and axially inserting the first wire end through the collar and into a first wire port of an open front end of a housing until the first wire is electrically engaged by a bus strip proximate a closed end of the housing within the push-in wire connector;

stripping a second wire end and axially inserting the second wire end through the collar and into a second wire port of the open front end of the housing, said second wire port laterally spaced from the first wire port until the second wire end is electrically engaged with the bus strip proximate the closed end of the housing within the push-in wire connector with the collar shielding both the first wire and the second wire from the environment but not from each other.

11. The method of claim 10 including the step of inserting the wire into the first wire port and subsequently inserting the second wire into the second wire port after the first wire is in electrical engagement with the bus strip in the push-in wire connector.

12. The method of claim 10 wherein the first wire end has a larger gauge than the second wire end with the collar extending past an exposed portion of the first wire and the second wire.

13. The method of claim 12 including cantileverly attaching the collar to a front face of the push-in wire connector with an inside face of the collar is laterally spaced from the first wire port and the second wire port.

* * * * *